US005964366A

United States Patent [19]

Hurst et al.

[11] Patent Number: 5,964,366

[45] Date of Patent: Oct. 12, 1999

[54] CAN END HAVING SCORE GROOVE WITH THICKENED RESIDUAL AREA

[75] Inventors: Robert L. Hurst, Golden; Dennis K. Hidalgo, Lakewood, both of Colo.

[73] Assignee: Coors Brewing Company, Golden, Colo.

[21] Appl. No.: 09/087,530

[22] Filed: May 29, 1998

Related U.S. Application Data

[63] Continuation of application No. 08/857,812, May 16, 1997, abandoned, which is a continuation of application No. 08/754,232, Nov. 20, 1996, abandoned.

[51] Int. Cl.[6] ..... B65D 17/32

[52] U.S. Cl. ..... 220/269; 220/270

[58] Field of Search ..... 220/269, 270–273; D9/438

[56] References Cited

U.S. PATENT DOCUMENTS

| | | | |
|---|---|---|---|
| D. 246,229 | 11/1977 | Saunders . | |
| D. 250,933 | 1/1979 | Saunders . | |
| D. 262,517 | 1/1982 | Hayes . | |
| D. 265,463 | 7/1982 | Hasegawa . | |
| D. 267,393 | 12/1982 | Gruodis et al. . | |
| D. 275,373 | 9/1984 | Brown et al. . | |
| D. 364,807 | 12/1995 | Taylor . | |
| D. 371,073 | 6/1996 | Taylor . | |
| D. 382,481 | 8/1997 | McEldowney | D9/438 |
| D. 385,192 | 10/1997 | Hurst et al. | D9/438 |
| 3,259,265 | 7/1966 | Stuart . | |
| 3,291,336 | 12/1966 | Fraze . | |
| 3,424,337 | 1/1969 | Von Stocker . | |
| 3,583,348 | 6/1971 | Brown | 29/522.1 X |
| 3,941,277 | 3/1976 | McKinney et al. . | |
| 3,967,752 | 7/1976 | Cudzik | 220/269 |
| 4,024,981 | 5/1977 | Brown | 220/269 |
| 4,175,670 | 11/1979 | Reynolds et al. . | |
| 4,184,607 | 1/1980 | Potts . | |
| 4,205,760 | 6/1980 | Hasegawa . | |
| 4,210,257 | 7/1980 | Radtke . | |
| 4,266,685 | 5/1981 | Lee, Jr. . | |
| 4,313,545 | 2/1982 | Maeda . | |
| 4,318,489 | 3/1982 | Snyder et al. . | |
| 4,320,850 | 3/1982 | Drolen, Jr. . | |
| 4,363,419 | 12/1982 | Walz, Sr. . | |
| 4,465,204 | 8/1984 | Kaminiski . | |
| 4,733,793 | 3/1988 | Moen . | |
| 4,804,104 | 2/1989 | Moen . | |
| 4,901,880 | 2/1990 | Tatham et al. . | |
| 4,939,665 | 7/1990 | Gold et al. . | |
| 5,064,087 | 11/1991 | Koch . | |
| 5,129,541 | 7/1992 | Voigt et al. . | |
| 5,375,729 | 12/1994 | Schubert | 220/269 X |
| 5,385,254 | 1/1995 | Hannon . | |
| 5,456,378 | 10/1995 | DeMars . | |
| 5,555,992 | 9/1996 | Sedgeley . | |
| 5,655,678 | 8/1997 | Kobayashi | 220/269 |
| 5,711,448 | 1/1998 | Clarke, III . | |
| 5,715,964 | 2/1998 | Turner et al. | 220/269 |

FOREIGN PATENT DOCUMENTS

0704382 A2 4/1998 European Pat. Off. .

OTHER PUBLICATIONS

InterBev '94 Show, Advertising Literature, "Reynolds Develops Large–Opening Ends", Oct. 1994.

*Primary Examiner*—Stephen K. Cronin
*Assistant Examiner*—Robin A. Hylton
*Attorney, Agent, or Firm*—Klaas, Law, O'Meara & Malkin, P.C.; William P. O'Meara, Esq.; Michael A. Goodwin, Esq.

[57] ABSTRACT

A can end for a two-piece beverage can including a score panel defined by an arcuate score line which comprises a score groove and a score residual portion. In order to control the opening speed of the score panel, the thickness of the score residual is varied along the score line. A thickened score residual area or areas may generally be located opposite the rivet area of the can end. The remainder of the score residual may be formed having a relatively smaller thickness, thus allowing opening of the end to be accomplished without the need for excessive force.

10 Claims, 8 Drawing Sheets

CAN END HAVING SCORE GROOVE WITH THICKENED RESIDUAL AREA

This application is a continuation of application Ser. No. 08/857,812 filed May 16, 1997, now abandoned which is a continuation of application Ser. No. 08/754,232 filed Nov. 20, 1996, now abandoned, which are both hereby incorporated by reference for all that is disclosed therein.

FIELD OF THE INVENTION

The present invention relates, generally, to can ends and more particularly, to a can end having an opening panel defined by a score line which includes a score groove and a score residual portion.

BACKGROUND OF THE INVENTION

Most beverage cans presently produced in the United States are so-called "two-piece cans" which are typically made from aluminum. A two-piece can includes a can body which has a cylindrical side wall portion and an integrally formed bottom wall portion. The can body is open at the top, terminating in an annular peripheral flange portion. The second component of a two-piece can is a can "lid" or "closure" which is more commonly referred to in the industry as a can "end". The can end has an annular peripheral flange or "curl" portion which is seamed to a corresponding peripheral flange portion of the can body to seal the opening in the can body. The can end is seamed to the can body after the can body has been filled with the desired beverage. Can ends are typically formed in a series of die presses which initially form the basic can end configuration or "shell". Subsequently the shell has various operations performed thereon, such as embossing, debossing, scoring, rivet formation and tab staking, to complete the end. A can end press is described in U.S. Pat. No. 4,939,665 of Gold et al. issued Jul. 3, 1990 which is hereby incorporated by reference for all that it discloses.

Most can ends used in the packaging of beverages such as soft drinks and beer include a score panel. The score panel may be formed by a pair of closely spaced score lines which are provided in a generally ring-shaped configuration referred to herein as a "score profile". In such a score panel, the inner score line is generally provided to add strength to the end.

The outer score line, on the other hand, usually defines the perimeter of the opening which is formed when the end is opened. The outer score line generally includes a score groove formed in the upper surface of the end. This score groove terminates at a score residual region which is formed between the bottom of the score groove and the lower surface of the end. The thickness of the score residual is dictated by the depth of the score groove. When the end is opened, the score residual is ruptured, thus allowing the score panel to deflect into the can. The outer score line, thus, actually defines the shape of the score panel.

In one popular type of can end, the beginning portion and end portion of the score profile are spaced-apart. This spaced-apart region does not rupture during opening of the score panel and acts to retain the score panel on the can end after the primary score line has been ruptured. In this type can end, a separately formed tab member has an intermediate portion thereof riveted to a central portion of the can end at a position on the can end adjacent to the score panel. The tab member has a first end portion, generally referred to as a nose, which is initially positioned in contact with the score panel. The tab member has an opposite end portion which is generally formed in a ring-shaped configuration. In opening the can end, a user grasps the ring portion of the tab member and pulls upwardly causing the tab member to pivot about an axis which is typically adjacent to the rivet on the tab nose end side of the rivet. Thus, pulling up on the ring end portion causes the nose end portion to be urged against the score panel causing the score panel to rupture and eventually to pivotally deflect about an axis defined generally by the gap between the beginning and end portions of the score profile. The following U.S. patents disclose various can end configurations and are hereby incorporated by reference for all that is disclosed therein: U.S. Pat. No. Des. 364,807 issued Dec. 5, 1995 of Taylor; U.S. Pat. No. Des. 265,463 issued Jul. 20, 1996 of Hasegawa; U.S. Pat. No. Des. 267,393 issued Dec. 28, 1982 of Gruodis et al.; U.S. Pat. No. Des. 275,373 issued Sep. 4, 1984 of Brown et al.; U.S. Pat. No. 3,259,265 issued Jul. 5, 1966 of Stuart; U.S. Pat. No. 3,291,336 issued Dec. 13, 1966 of Fraze; U.S. Pat. No. 3,424,337 issued Jan. 28, 1969 of Von Stocker; U.S. Pat. No. 4,205,760 issued Jun. 3, 1980 of Hasegawa; U.S. Pat. No. 4,210,257 issued Jul. 1, 1980 of Radtke; U.S. Pat. No. 4,465,204 issued Aug. 14, 1984 of Kaminski et al.; U.S. Pat. No. Des. 246,229 issued Nov. 1, 1977 of Saunders; U.S. Pat. No. Des. 250,933 issued Jan. 30, 1979 of Saunders;

U.S. Pat. No. Des. 262,517 issued Jan. 5, 1982 of Hayes; U.S. Pat. No. 4,175,670 issued Nov. 27, 1979 of Reynolds et al.; U.S. Pat. No. 4,266,685 issued May 12, 1981 of Lee, Jr.; U.S. Pat. No. 4,313,545 issued Feb. 2, 1982 of Maeda; U.S. Pat. No. 4,318,489 issued Mar. 9, 1982 of Snyder et al.; U.S. Pat. No. 4,733,793 issued Mar. 29, 1988 of Moen et al.; U.S. Pat. No. 4,804,104 issued Feb. 14, 1989 of Moen et al.; U.S. Pat. No. 5,555,992 issued Sep. 17, 1996 of Sedgeley; U.S. patent application Ser. No. 08/593,035 filed Feb. 23, 1996 for CAN END WITH EMBOSS AND DEBOSS SCORE PANEL STIFFENING BEADS of Tim L. Turner and Robert L. Hurst and U.S. Design patent application Ser. No. 29/051,035 filed Feb. 23, 1996 for CAN END (design) of Robert L. Hurst and Tim L. Turner.

Score panel design requires a careful balancing of design parameters. In particular, the thickness of the score residual must be carefully chosen to ensure proper operation of the can end. If a designer selects a score residual which is too thin, the resulting can ends are subject to being ruptured during the production and during packaging and shipping operations. On the other hand, if the score residual is too thick, excessive force may be required to rupture the score.

It has been found that, in many cases, even can ends formed with an optimal score residual thickness may display certain problems. Specifically, it has been found that, when the score residual is sufficiently thin to allow proper opening, the score line residual sometimes ruptures too quickly, causing the score panel to rapidly move into contact with the beverage contained in the can. This, in turn, may cause a portion of the beverage to splash out of the can in an undesirable manner when the can is opened. Further, if the beverage in the can is a carbonated beverage, the rapid movement of the score panel may also cause the beverage to foam excessively in an undesirable manner.

Thus, it would be generally desirable to provide a can end which overcomes these problems associated with opening characteristics.

SUMMARY OF THE INVENTION

The present invention is directed to a can end for a two-piece beverage can. The can end has a generally flat, radially extending portion. A score panel is defined in the generally flat radially extending portion by an arcuate score line which comprises a score groove and a score residual portion. The thickness of the score residual portion is varied along the score line so that it is thicker in an area or areas where the rupturing of the score residual tends to accelerate during opening of the can end. The thickened score residual area or areas causes a slowing of the speed at which the score residual ruptures and, thus, slows the score panel as it moves into contact with the contents of the can.

The thickened score residual area or areas may generally be located opposite the rivet area of the can end where, it has been discovered, the undesirable acceleration of the score rupture generally occurs. The remainder of the score residual may be formed having a relatively smaller thickness, thus allowing opening of the end to be accomplished without the need for excessive force.

Thus, the end having a selectively located thickened score residual area causes the speed of the score panel to be reduced while allowing normal opening forces to be applied to initiate opening of the end.

BRIEF DESCRIPTION OF THE DRAWINGS

An illustrative and presently preferred embodiment of the invention is shown in the accompanying drawing in which.

DETAILED DESCRIPTION OF THE INVENTION

In General

Figure 1:
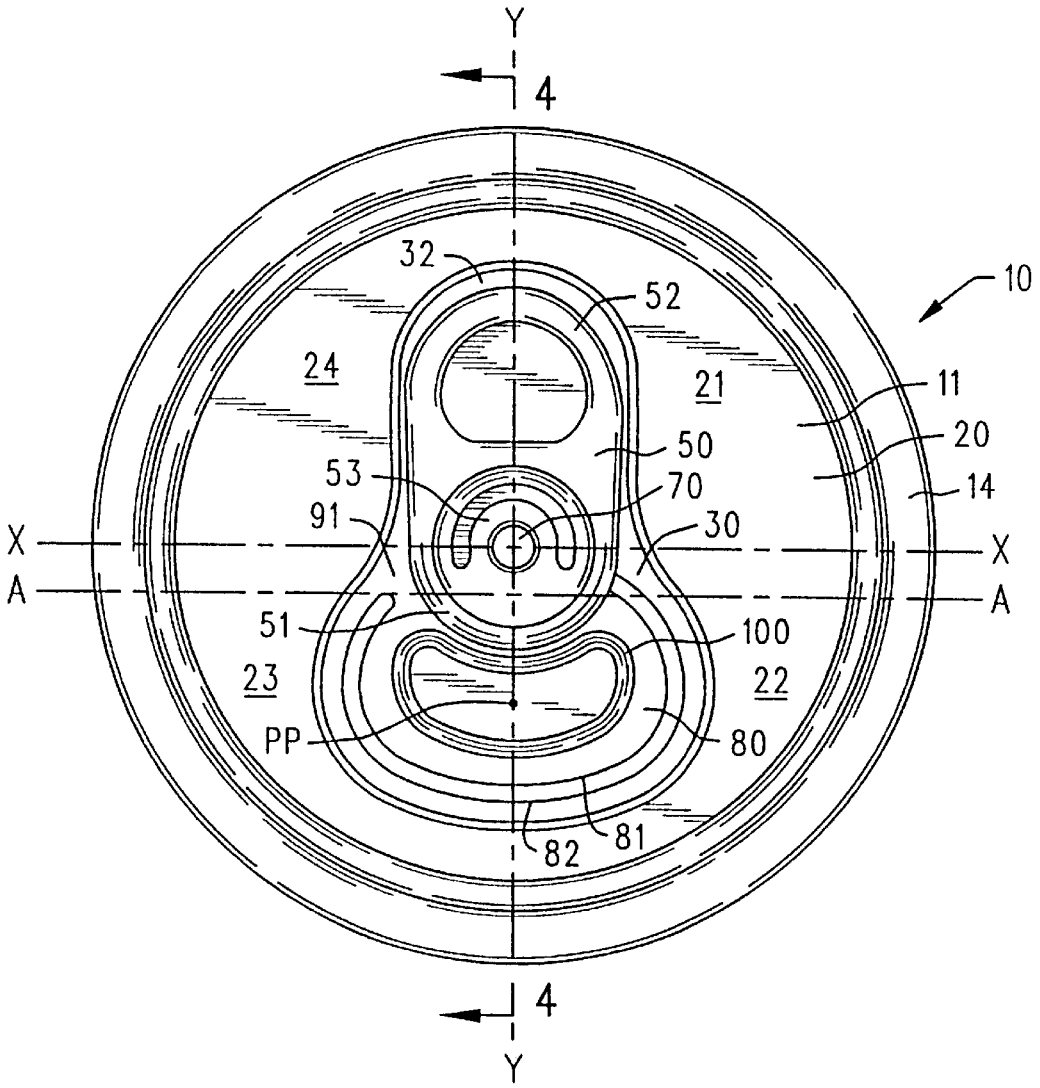
FIG. 1 is a top plan view of a can end.
Figure 2:
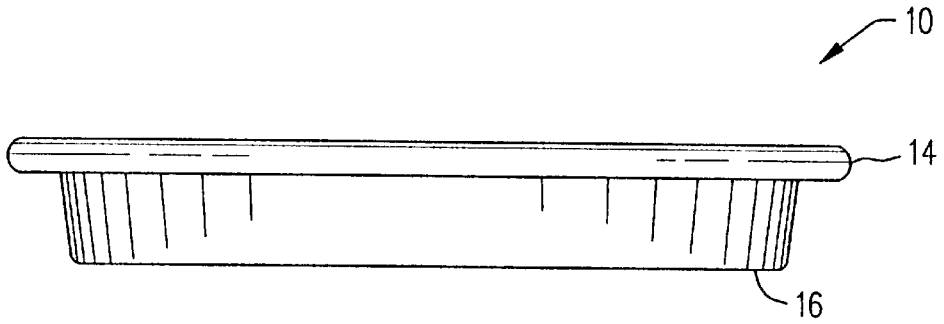
FIG. 2 is a side elevation view of a can end.
Figure 3:
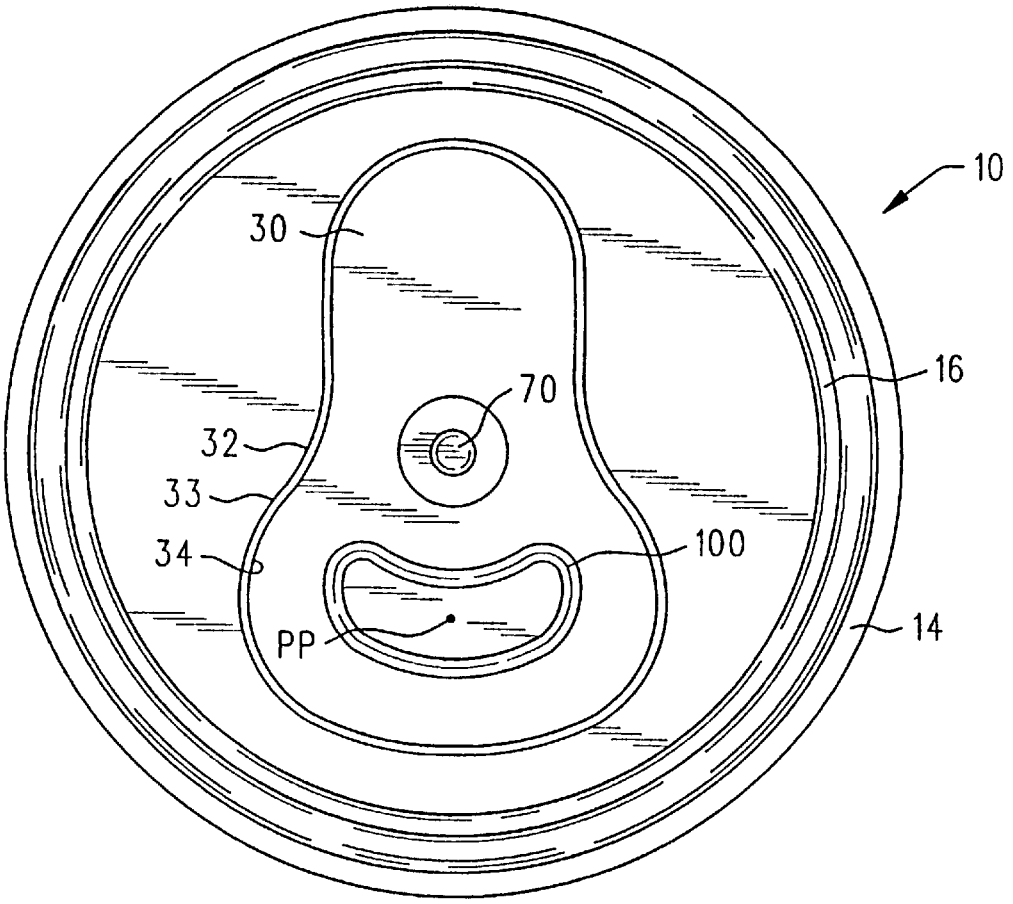
FIG. 3 is a bottom plan view of a can end.

FIGS. 1–12 illustrate, in general, a can end 10 for a two-piece beverage can. The can end 10 includes a generally flat portion 30 extending generally in a radial plane and having an upper surface 11 and a lower surface 12; a rivet mechanism 70 formed in the generally flat portion 30, the rivet mechanism having a central longitudinal axis ZZ extending in an axial direction which is substantially perpendicular to the radial plane. The end 10 may also include a displaceable panel 80 defined in the generally flat portion 30 by a score line 82. The score line 82 includes a score groove 168, FIG. 9, extending from the upper surface 11 toward the lower surface 12 and a frangible residual portion 93 located between the score groove 168 and the lower surface 12. The displaceable panel 80 is connected to the remainder of the flat portion 30 by a non-scored hinge portion 91. A first transverse axis YY lies generally in the radial plane and intersects the rivet central longitudinal axis ZZ. A pull tab 50 is attached to the generally flat portion 30 by the rivet mechanism 70. The pull tab 50 is generally symmetrical with respect to the first transverse axis YY. A second transverse axis BB is perpendicular to the first transverse axis YY and lies generally in the radial plane. The second transverse axis BB intersects a first portion 87 and a second portion 89 of the score line 82 and is located such that the distance along the second transverse axis BB between the score line first portion 87 and the score line second portion 89 is maximized. The second transverse axis BB intersects the first transverse axis YY at a displaceable panel central point 174.

The first YY and second BB transverse axes define four quadrants 161, 162, 163, 164, progressing in a clockwise direction when the can end 10 is viewed from the upper surface 12 thereof as follows:

- a first quadrant 161 containing a portion of the rivet mechanism 70 and a portion of the score line 82;
- a second quadrant 162 located immediately adjacent the first quadrant 161 and containing a portion of the score line 82;
- a third quadrant 163 located immediately adjacent the second quadrant 162 and containing a portion of the score line 82; and
- a fourth quadrant 164 located immediately adjacent both the third 163 and first 161 quadrants, the fourth quadrant containing at least a portion of the hinge portion 91, a 15 portion of the rivet mechanism 70 and a portion of the score line 82.

A third transverse axis DD lies in the radial plane and intersects the displaceable panel central point 174. The third transverse axis DD lies at an angle of 45 degrees with respect to the first YY and second BB transverse axes. The third transverse axis DD intersects the score line 82 in the second quadrant 162 at a first intersection point 190.

A fourth transverse axis EE lies in the radial plane and intersects the displaceable panel central point 174. The fourth transverse axis EE lies at an angle of 45 degrees with respect to the first YY and second 25 BB transverse axes. The fourth transverse axis EE intersects the score line 82 in the third quadrant 163 at a second intersection point 192.

Figure 9:
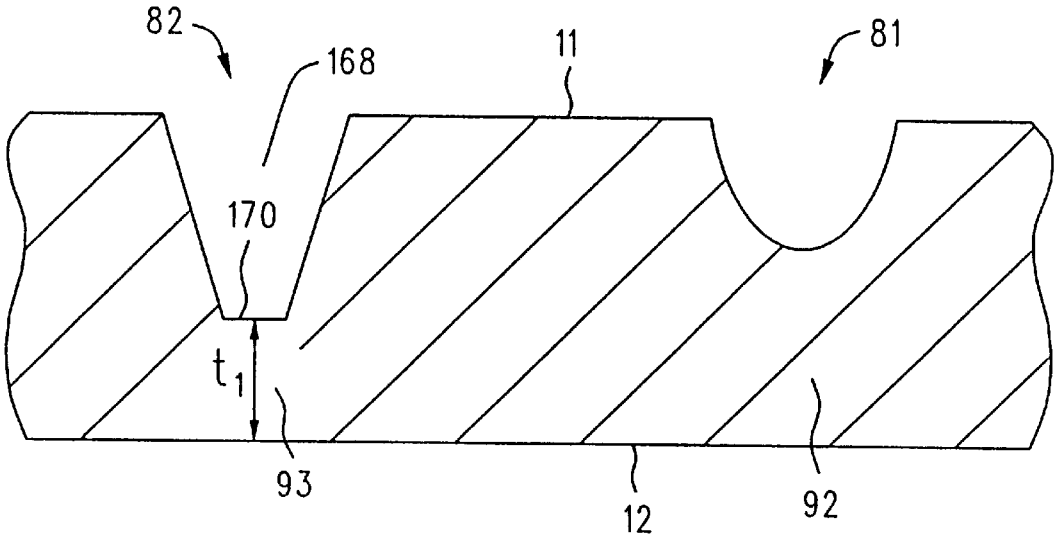
FIG. 9 is a cross-sectional view taken along the line 9—9 of FIG. 7.

The frangible residual portion 93 includes a thickened portion 186 having a thickness "$t_2$", FIG. 9, measured in the direction of the rivet central longitudinal axis ZZ, which is relatively larger than at least one other portion of the frangible residual portion 93. The thickened portion 186 is at least partially located between the first 190 and second 192 intersection points.

FIGS. 1–12 also illustrate, in general, a can end 10 including a generally flat portion 30 extending generally in a radial plane and having an upper surface 11 and a lower surface 12, and a displaceable panel 80 defined in the generally flat portion 30 by a generally elliptical score line 82. The score line 82 comprises a score groove 168, FIG. 9, extending from the upper surface 11 toward the lower surface 12 and a frangible residual portion 93 located between the score groove 168 and the lower surface 12. The can end 10 also includes a rivet mechanism 70 formed in the generally flat portion 30 at a 12 o'clock position 93 with respect to the displaceable panel 80. A non-scored hinge portion 91 connects the displaceable panel 80 to the remainder of the flat portion 30, the hinge portion 91 being located generally at an 11 o'clock position relative to the displaceable panel 80.

The frangible residual portion 93 includes a thickened portion 186 having a thickness which is relatively larger than at least one other portion of the frangible residual portion 93. The thickened portion 186 is at least partially located between the 4:30 o—lock and 7:30 o—clock positions with respect to the displaceable panel 80.

Having thus described the can end 10 in general, various features of the can end will now be described in further detail and operation of the can end will also be described.

Shell

Figure 4:
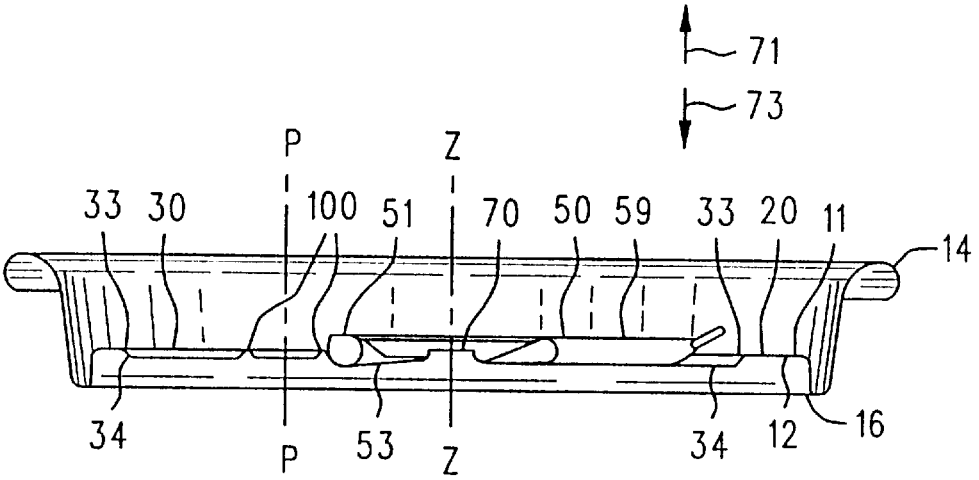
FIG. 4 is a cross-sectional elevation view of a can end.

As best illustrated in FIG. 4, can end 10 is formed from a thin metal shell having a top surface 11 and bottom surface 12. In one preferred embodiment, the can end is of a standard type known in the industry as a "204 end", although this technology may also be applied to larger or smaller can ends. A 204 end has a diameter of two and four sixteenths inches after it is seamed to a can body. The pre-seaming diameter may be 2.452 inches. In one preferred embodiment, the thickness of the can end metal is preferably between about 0.0085 inches and about 0.0095 inches thick, and most preferably less than 0.0093 inches thick. The can end has a peripheral curl portion 14 and an annular countersink bead 16 of a conventional type used on 204 ends. The total height of the end from the top of the curl to the bottom of the countersink bead may be about 0.269 inches. Integrally connected to the countersink bead 16 is a generally flat, main panel 20 which is also conventional and known in the art. The main panel may be spaced about 0.090 inches from the bottom of the countersink bead.

A rivet 70 described in further detail below, is formed at the center of the main panel 20 and has orthogonal axes XX, YY and ZZ as shown in FIGS. 1 and 4. Axes XX and YY define a plane parallel to panel 20 and divide the can end into first, second, third and fourth quadrants 21, 22, 23, 24, respectively.

Deboss Panel

Figure 6:
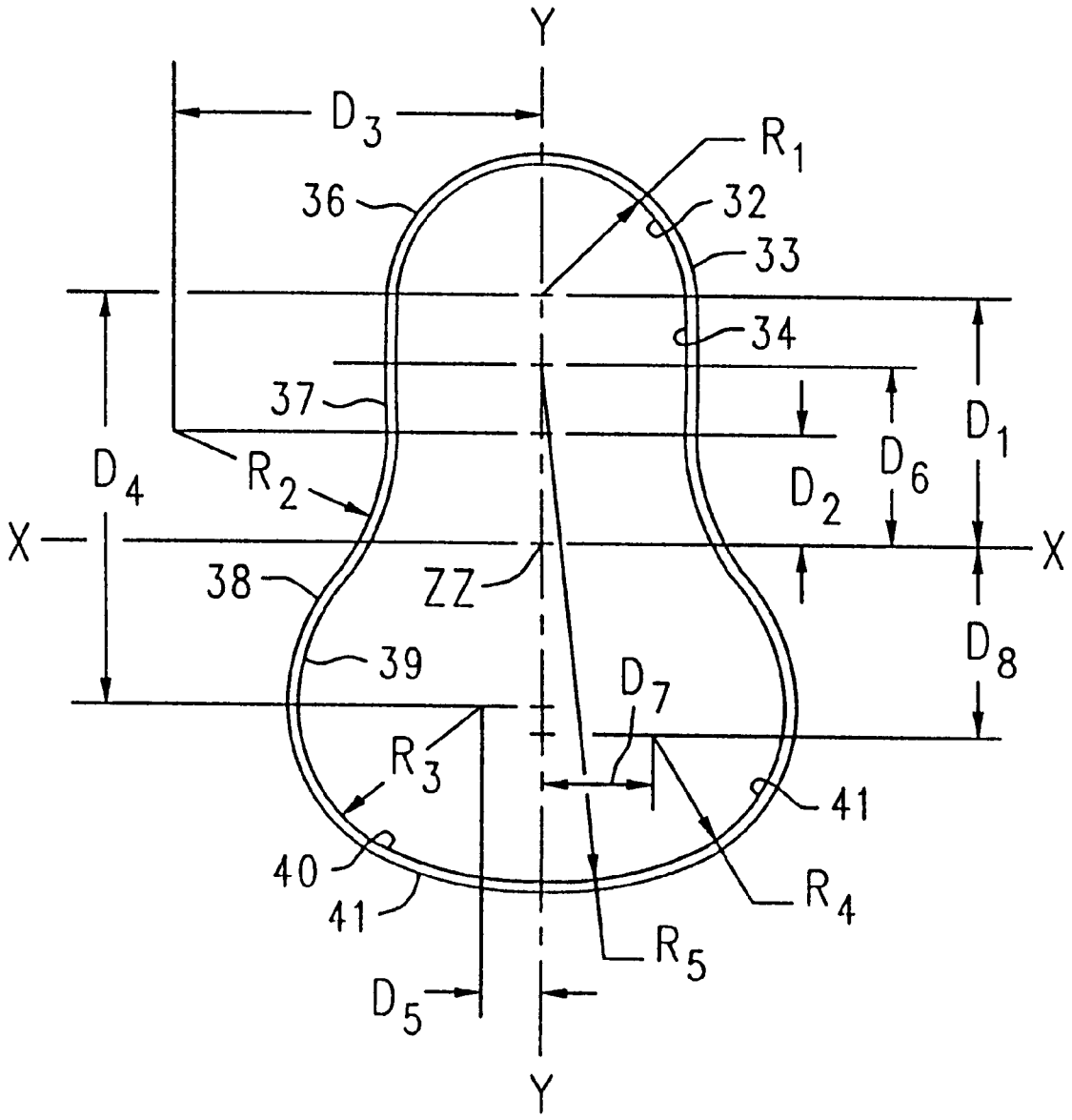
FIG. 6 is a top plan view of a can end deboss panel.

A deboss panel 30, as best shown in FIGS. 1, 3, 4 and 6, is formed in the main panel 20 using conventional die-forming techniques. The deboss panel 30 has a generally, pear-shaped deboss profile 32 which is, in turn, defined by an outer radius line 33 and an inner radius line 34. The outer radius line may have a radius of 0.015 inches with a center of curvature below bottom surface 12 and the inner radius line may have a radius of 0.015 inches with a center of curvature above top surface 11. The depth of the deboss profile, i.e., the vertical distance between outer radius line 33 and inner radius line 34 may be about 0.019 inches. The width of the deboss profile, i.e., the lateral distance between the outer and inner radius lines, may be about 0.015 inches. The deboss panel has bilateral symmetry with respect to a plane defined by axes YY and ZZ. In view of the bilateral symmetry of the pear-shaped, deboss profile, only one-half of the deboss profile will be described since the opposite half is a mirror image thereof. The deboss panel, as shown by FIG. 6, includes a first arcuate portion 36 having a radius of curvature $R_1$ (as measured to the inner radius line 34) of about 0.3420 inches. Portion 36 is connected to a second, straight portion 37 which is, in turn, connected to a third, arcuate portion 38 having a radius $R_2$ of about 0.5000 inches. Portion 38 is connected to a fourth, arcuate portion 39 having a radius $R_3$ of about 0.4270 inches. Portion 39 is, in turn, connected to a fifth, arcuate portion 40 having a radius $R_4$ of about 0.3150 inches. Portion 40 is connected to a sixth arcuate portion 41 having a radius $R_5$ of about 1.0650 inches. The centers of curvature of the arcuate portions described above are as indicated by the dimensions $D_1$–$D_8$ which may be generally as follows: $D_1$=0.5087 inches; $D_2$=0.2082 inches; $D_3$=0.8420 inches; $D_4$=0.9036 inches; $D_5$=0.138; $D_6$=0.2393 inches; $D_8$=0.2099 inches and $D_8$=0.4807 inches.

The deboss panel 30 may also include a downwardly extending depression, not shown, to facilitate lifting of the tab, as described below, when the can end 10 is opened by a user. Such a depression may, in a conventional manner, be located in the area of deboss panel portion 36.

Tab

As best illustrated in FIGS. 1 and 4, a tab 50 is attached to the can end by central annular rivet 70. The tab 50 has a rounded nose portion 51 at one end (which may have a radius of curvature of about 0.500 inches), a ring-pull portion 52 at the opposite end, and an intermediate portion 53 which is staked to the end by center rivet 70. The nose portion 51 is formed, in part, by a nose curl 56 best illustrated in FIG. 5. A lower surface portion 57 of the nose curl makes contact with a lower portion 122 of the score panel 80, FIG. 5. The tab member 50 (sometimes referred to herein simply as "tab") in operation, pivots about a tab pivot axis AA which is positioned parallel to axis XX at a position adjacent to the rivet 70 as best illustrated in FIG. 1. The tab member has an annular, inner peripheral edge 58 positioned next adjacent central rivet 70, FIG. 5. The tab, in one preferred embodiment, has a nose thickness, $D_{10}$, FIG. 5, of about 0.061 inches. The radial distance, $D_{11}$, from the nose contact point 57 to the rivet centerline ZZ may be about 0.490 inches. The tab member may have a length of about 0.990 inches and may be identical to most tabs currently used on beverage cans. The tab width may be about 0.625 inches. The tab member 50, like the deboss panel 30 has bilateral symmetry with respect to a plane defined by axes YY and ZZ. The end of the tab ring pull portion 52 may be tilted upwardly, in a conventional manner, to facilitate lifting by a user when the can end 10 is opened.

Rivet

Figure 5:
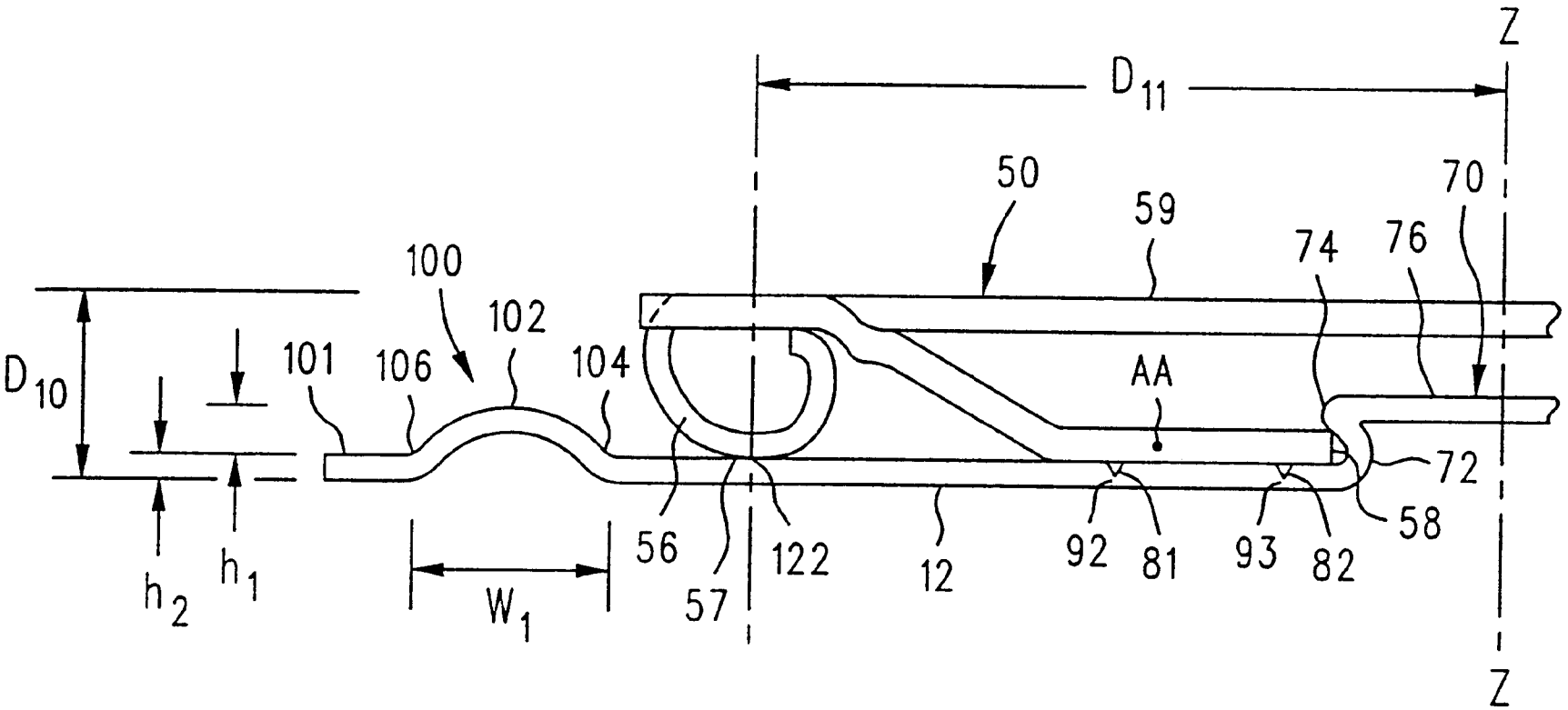
FIG. 5 is a detail cross-sectional elevation view of a can end.

As best illustrated by FIGS. 1, 4 and 5, central annular rivet 70 comprises an upright portion 72 which is joined through a shoulder portion 74 to an upper head portion 76 of the rivet. The annular, inner peripheral edge 58 of the tab is positioned next adjacent to the upright portion 72 in touching or near touching contact therewith. The shoulder portion 74 extends radially outwardly above the peripheral edge 58 of the tab, thus securing the tab member 50 to the can end 10.

Score Panel

Figure 7:
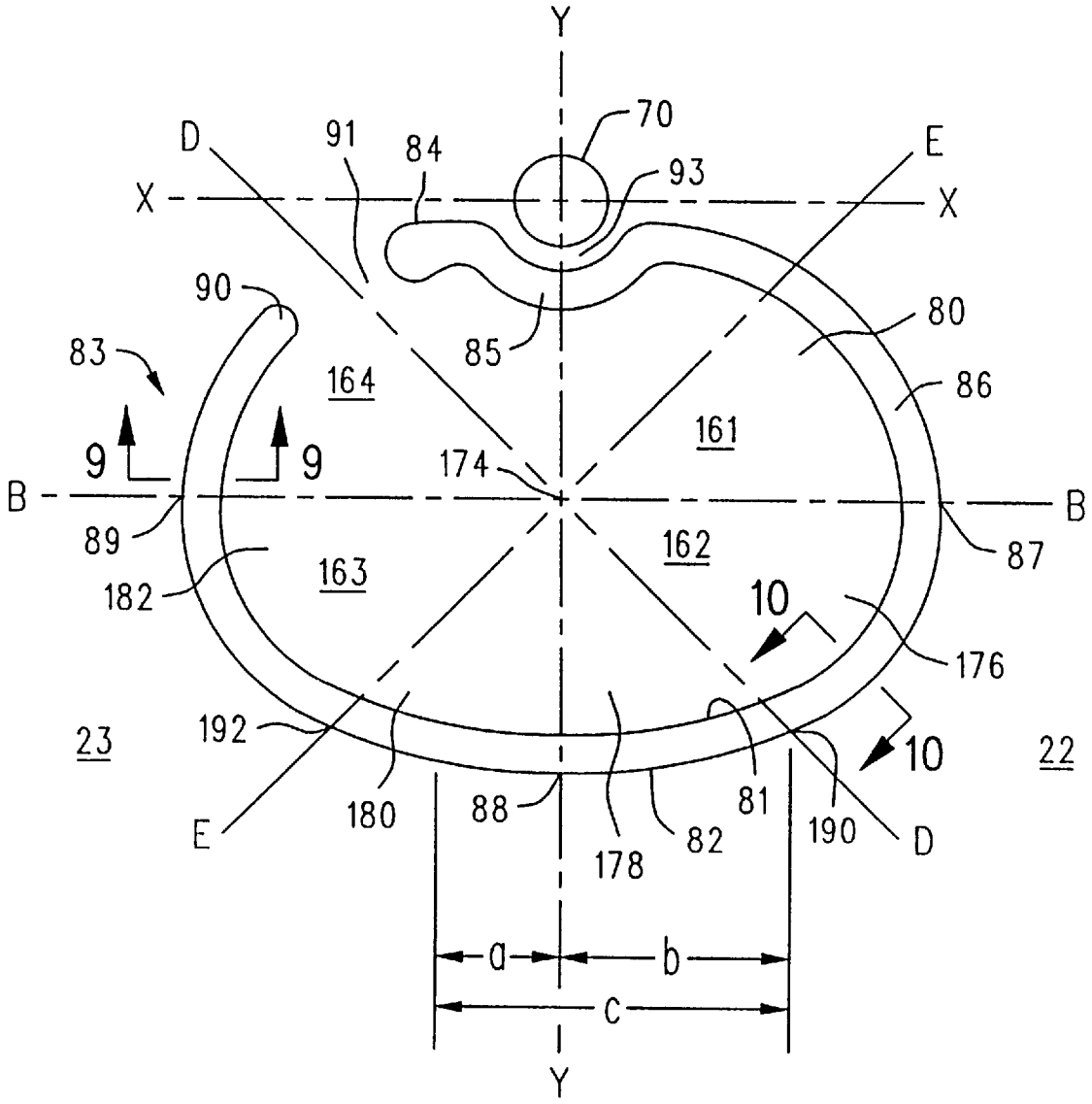
FIG. 7 is a top plan view of a can end score profile and rivet.

A score panel 80 is defined by a generally elliptical score profile 83 which is, in turn, defined by inner, antifracture score 81 and outer, primary score 82, as best illustrated in FIG. 7. However, this invention can also be used on ends with only a primary score. FIG. 9 shows a cross-sectional view taken along the line 9—9 in FIG. 7. As can be seen from FIG. 9, primary score 82 includes a groove 168 extending downwardly from the upper surface 11 of the end 10. The groove 168 terminates at a lower portion 170. A solid residual portion 93 is located between the score groove lower portion 170 and the lower surface 12 of the end 10. As will be explained in further detail herein, when the end 10 is opened, the residual portion 93 ruptures to allow the score panel 80 to separate from the remainder of the end, thus allowing an opening to be formed for dispensing the product contained in the can in a conventional manner. Antifracture score 81 may be provided to add strength to the score panel in a conventional manner.

Referring again to FIG. 7, the score panel 80 has an axis BB which is perpendicular to and intersects the axis YY and is parallel to the axis XX. The axis BB is located along the axis YY such that the intersection points 87, 89 between the axis BB and the primary score 82 are spaced a maximum distance apart. In other words, the axis BB is located generally at the maximum axis of the generally elliptically shaped score profile 83.

Axes YY and BB define a plane parallel to panel 20 and divide the score panel 80 into first, second, third and fourth quadrants 161, 162, 163 and 164, respectively. As can be seen from FIG. 7, the score panel first and second quadrants 161, 162 are both located in the can end quadrant 22 while the score panel third and fourth quadrants are both located in the can end quadrant 23.

As can further be seen from FIG. 7, the score panel first quadrant 161 includes a portion of the rivet 70. Score panel second quadrant 162 is located immediately adjacent the score panel first quadrant 161. Score panel third quadrant 163 is located immediately adjacent score panel second quadrant 162. Score panel fourth quadrant 164 is located immediately adjacent score panel third quadrant 163 and score panel first quadrant 161 and contains both the hinge 91 and a portion of the rivet 70.

Score panel second quadrant 162 may also include a first half 176 located immediately adjacent score panel first quadrant 161 and a second half 178 located immediately adjacent the first half 176 and the score panel third quadrant 163. First half 176 and second half 178 are separated by an axis DD as shown. The axis DD is perpendicular to the axis PP, FIG. 4, and passes through the intersection point 174, FIG. 7. The axis DD forms an angle of 45 degrees with respect to both the axis BB and the axis YY and, thus, bisects the score panel second quadrant 162. The axis DD intersects the primary score line 82 at a point 190.

Score panel third quadrant may also include a first half 180 and a second half 182. First half 180 is located immediately adjacent the second half 178 of score panel second quadrant 162. Second half 182 is located immediately adjacent the first half 180 and the score panel fourth quadrant 164. First half 180 and second half 182 are separated by an axis EE as shown. The axis EE is perpendicular to the axis PP, FIG. 4, and passes through the intersection point 174, FIG. 7. The axis EE forms an angle of 45 degrees with respect to both the axis BB and the axis YY and, thus, bisects the score panel third quadrant 163. The axis EE intersects the primary score line 82 at a point 192.

The score profile 83 may include an enlarged first end portion 84 positioned near rivet 70 in the score panel fourth quadrant 164. An arcuate portion 85 is connected to end portion 84 and has a shape which is generally concentric to the outer edge surface of rivet 70. A generally, elliptical portion 86 is connected to portion 85 and comprises a 3 o'clock position 87, a 6 o'clock position 88, a 9 o'clock position 89 and a 12 o'clock position 93. As previously described, the 3 o'clock and 9 o'clock positions 87, 89 lie on the axis BB. The 6 o'clock position 88 and the 12 o'clock position lie on axis YY. The radial distance between the primary score 82 and the inner radius line 34 of the deboss panel may be constant from the 3 o'clock through the 6 o'clock and 9 o'clock positions and may be about 0.150 inches. Generally elliptical portion 86 terminates at second end portion 90 which terminates short of first end portion 84. The gap 91, between the first and second end portions 84, 90, which may be about 0.110 inches long, defines a hinge 91 about which the score panel 80 ultimately pivots after the score profile is fully ruptured.

The dimension of the major score profile axis BB, i.e. from the 3 o'clock to the 9 o'clock position of the primary score may be about 1.00 inch. The dimension along axis YY from the centerline of the rivet to the 6 o'clock position of the primary score may be about 0.760 inches.

Emboss Bead

The configuration of annular emboss bead 100 is illustrated in FIGS. 1, 4, 5 and 8. The emboss bead 100 has a central crest portion 102 which may have a height $h_1$, FIG. 5, above the adjacent, inwardly-positioned, flat top surface portion 101 of deboss panel 30 of about 0.010 inches. The emboss bead 100 also comprises an inner edge 106 and an outer edge 104. As shown in FIG. 5, the emboss bead width $w_1$, between the outer and inner edges 104, 106, may be about 0.05 inches. The thickness "$h_2$" of the metal forming the end 10 in the vicinity of the emboss bead 100 may be about 0.006 inches.

Figure 8:
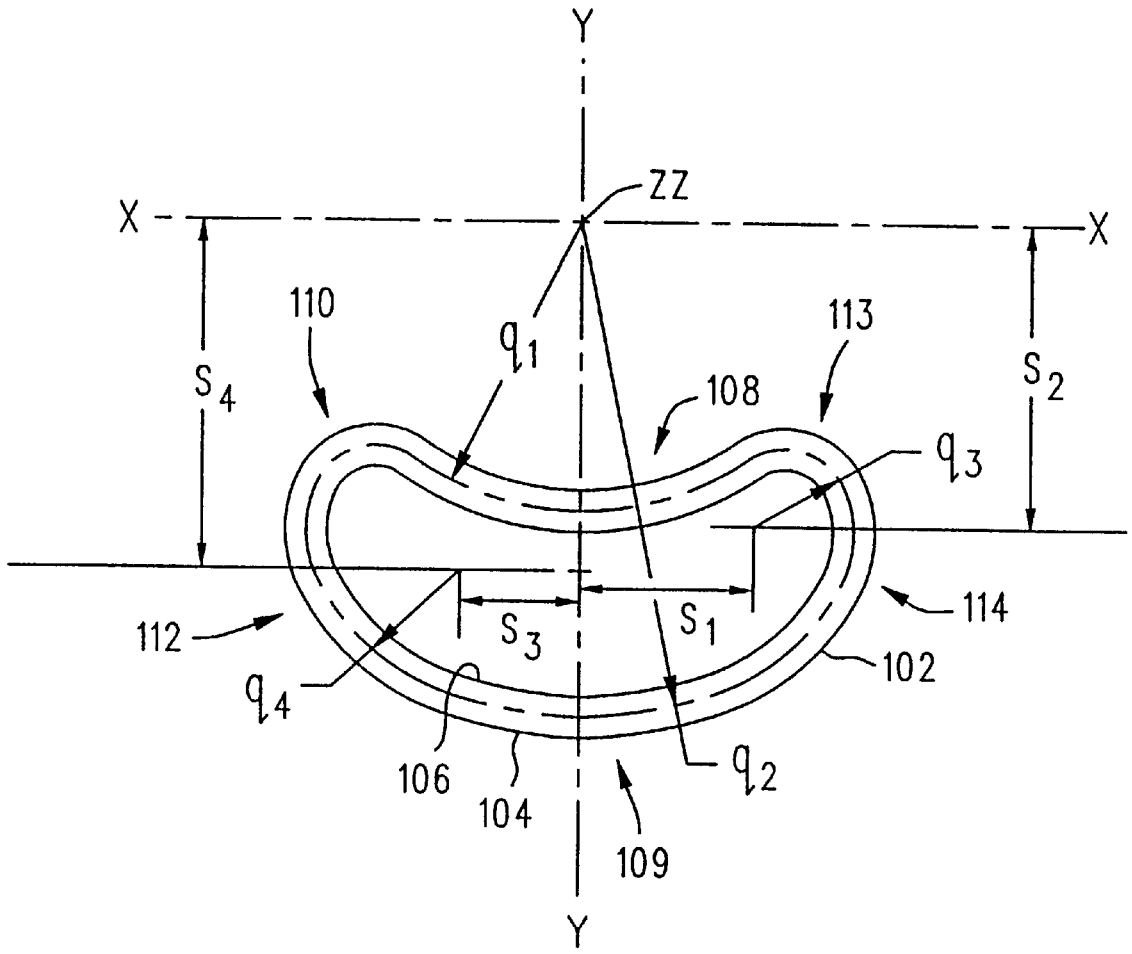
FIG. 8 is a top plan view of a score panel emboss bead.

The annular emboss bead 100 may have a first, curved portion 108, FIG. 8, which has a radius $q_1$, of about 0.3450 inches (measured to the emboss bead crest portion 102) and a center of curvature located at the intersection of the axes YY, XX and ZZ as shown. The emboss bead may have a second curved portion 109, FIG. 8, which is positioned opposite the first portion 108 and which has a radius $q_2$ of about 0.6152 inches. The center curvature of the radius $q_2$ may also be located at the intersection of the axes YY, XX and ZZ. The emboss bead 100 may comprise a third curved portion 110 which is integrally connected to the first portion 108 and which has a radius $q_3$ of about 0.1000 inches. The emboss bead 100 may further comprise a fourth curved portion 112 which is integrally connected to both the third portion 110 and the second portion 109 and which has a radius $q_4$ of about 0.1995 inches. The emboss bead 100 may also include a fifth portion 113 and a sixth portion 114 which are mirror images (with respect to the plane YY-ZZ) of the third and fourth portions 110, 112, respectively.

The centers of curvature of the curved portions described above are as indicated by the dimensions $S_1$–$S_4$ which may be generally as follows: $S_1$=0.2286 inches; $S_2$=0.3818 inches; $S_3$=0.1300 inches and $S_4$=0.3949 inches.

Score Residual

Before the end 10 is opened, the score residual 93, FIG. 9, is intact along the entire primary score 82, FIG. 7. Accordingly, the intact score residual serves to connect the score panel 80 to the remainder of the can end 10 and, thus, maintain the can in a sealed condition. When the end is to be opened, the ring pull portion 52 of the tab 50, FIG. 1, is lifted, causing the tab 50 to begin to pivot generally about the axis AA. This pivoting motion causes the lower surface portion 57 of the tab 50 to exert a force against the upper surface of the score panel 80, FIG. 5. When sufficient force is exerted, the score residual portion 93 of the primary score 82 will rupture, initially in the area of the arcuate portion 85, FIG. 7. Continued pivoting of the tab 50 will cause the primary score residual to continue to rupture around the score profile 83, through the 3 o'clock position 87, then the 6 o'clock position 88, the 9 o'clock position 89 and eventually stopping at the second end portion 90. At this point, the score panel 80 has deflected into the can body about the hinge 91. The end is now fully opened and the contents of the can may be dispensed through the opening defined by the primary score 82.

As previously described, it has been found that, when opening some can ends, the score line residual ruptures too quickly, causing the score panel to rapidly move into contact with the beverage contained in the can. This, in turn, may cause a portion of the beverage to splash out of the can in an undesirable manner when the can is opened. Further, if the beverage in the can is a carbonated beverage, the rapid movement of the score panel may also cause the beverage to foam excessively in an undesirable manner.

Although providing a uniformly thicker score residual 93 will slow down the opening speed of the end, such a uniformly thicker residual poses other problems. Specifically, thickening the score residual sufficiently to control the opening speed of the score panel may result in the end being inoperable. It is conventional to provide a thickened score area generally in the 12 o'clock region of a can end in order to make the end more resistant to accidental score line rupture which sometimes occurs in the 12 o'clock region, for example, due to rough handling during shipping of filled cans. It has been found that providing such a thickened score residual in the 12 o'clock region does not substantially interfere with the opening operation of the end. It has also been found, however, that providing a thickened score residual in certain other areas, such as the 3 o'clock and 9 o'clock positions, often results in the end being difficult or impossible to open properly.

Accordingly, it is an object of the present invention to selectively provide a thickened score residual in areas where undesirable acceleration of the score rupture occurs and not in other areas where such thickening might impair the proper opening operation of the end.

Figure 10:
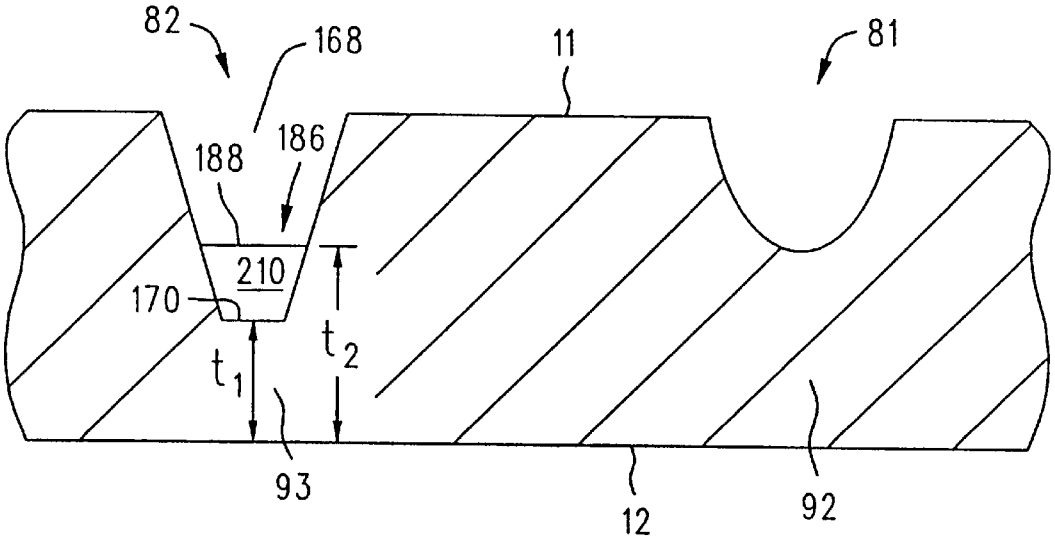
FIG. 10 is a cross-sectional view taken along the line 10—10 of FIG. 7.
Figure 11:
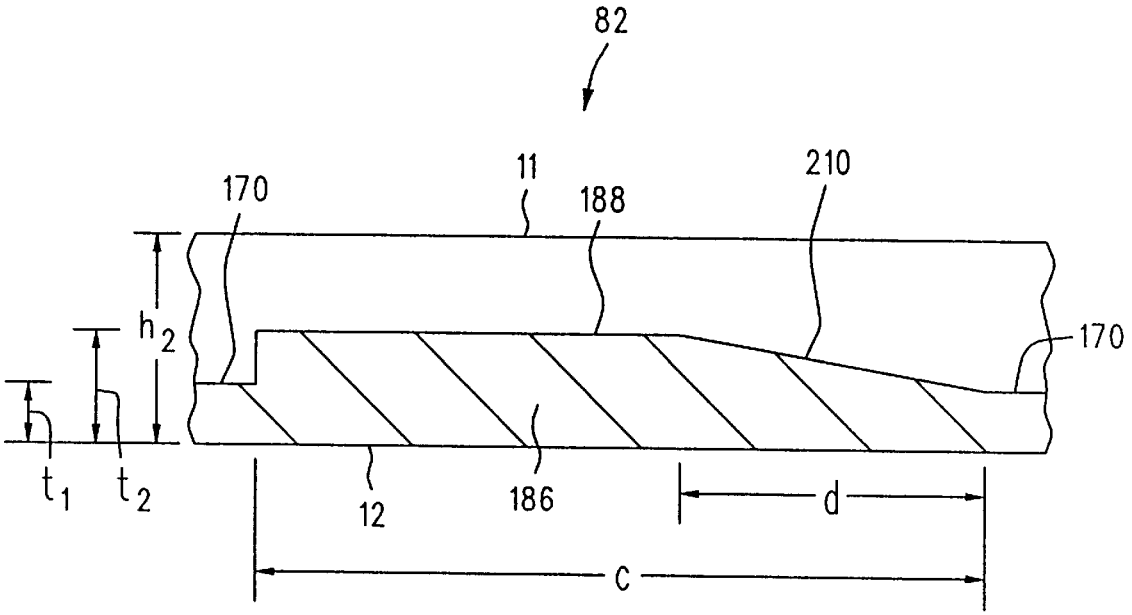
FIG. 11 is a cross-sectional view taken along the middle of the primary score line of the score profile of FIG. 7.

FIGS. 10 and 11 illustrate a thickened score residual portion 186. The upper surface 188 of thickened portion 186 may have a height $t_2$ above end lower surface 12 of about 0.0039 inches. Adjacent the thickened portion 186, the score residual upper surface 170 may have a height $t_1$ above end lower surface 12 of about 0.0035 inches. In the area of the thickened residual portion 186, thus, the score residual may be about 0.0004 inches thicker than in the remainder of the score profile. As can be seen from FIG. 11, the score residual thickened portion 186 may include a ramped surface 210 which slopes from the thickened portion upper surface 188 to the adjacent score residual upper surface 170 as shown. The ramped surface 210 may extend for a distance "d" of about 0.090 inches.

It has been discovered that rupture of the score residual tends to accelerate most rapidly generally between the 4:30 o'clock and the 7:30 o'clock positions. These positions correspond to the intersect point 190, FIG. 7, in the second half 178 of the score panel second quadrant 162 and the intersect point 192 in the first half 180 of the score panel third quadrant 163, respectively. It is, thus, in this general area that the undesirable acceleration of the score panel into the can contents most commonly occurs. Accordingly, in the present invention, the thickened score residual portion 186 may be located between the intersect point 190 and the intersect point 192 in the second half 178 of the score panel second quadrant 162 and the first half 180 of the score panel third quadrant 163.

Referring to FIG. 7, thickened portion 186 may extend for a distance "b" of about 0.280 inches in the score panel second quadrant second half 178 and for a distance "c" of about 0.125 inches in the score panel third quadrant first half 180 as shown. Accordingly, the thickened portion 186 may have an overall length "c" of about 0.405 inches. With the thickened portion 186 located as described above, the ramped surface 210 will be entirely located in the second quadrant second half 178. It is noted that the lengths specified above are measured in a plane perpendicular to the axis YY as shown in FIG. 7. Because the primary score 82 is curved, however, the actual length of the thickened portion 186 along the score 82 will be slightly longer.

Figure 12:
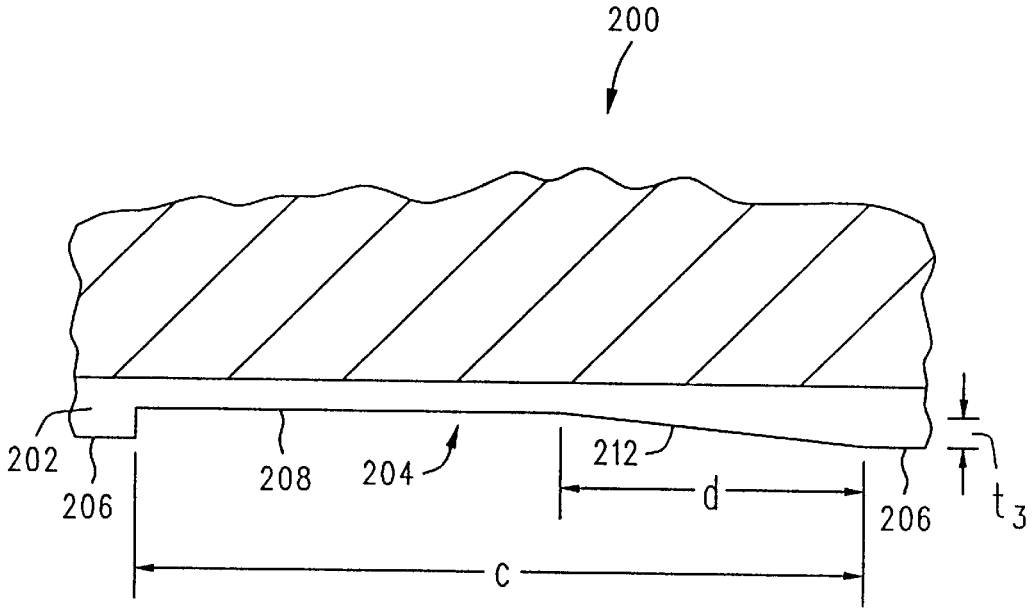
FIG. 12 is a cross-sectional view of a die tool used to form the score profile of FIG. 7.

FIG. 12 illustrates a sectional view of a portion of a die tool 200 used to manufacture the thickened score residual portion 186 described above. The tool 200 may include a score knife 202. The score knife 202 cooperates with a lower anvil, not shown, in a conventional manner to form the score groove 82 in the end 10. As shown in FIG. 12, the score knife 202 may include a recessed portion 204 having a length "c" equal to the length "c" of the residual thickened portion 186 previously described. The score knife 202 may also include a ramped surface 212 which slopes between the recessed surface 208 and the surface 206 as shown. The ramped surface 212 may have a length "d" equal to the length "d" of the residual thickened portion ramped surface 210 previously described.

Thus, when the end is manufactured, the edge 206 of the score knife 202 forms the surface 170, FIG. 8 and the edge 208 of the score knife 202 forms the surface 188, FIG. 9. Referring again to FIG. 11, it can be seen that the difference $t_3$ in heights between the edges 206 and 208 causes the difference between the height $t_1$ of the surface 170 and the height $t_2$ of the surface 188, FIG. 10, as previously described.

It is noted that, although the thickened portion 186 has been described as being located in both the second and third score panel quadrants 162, 163 respectively, the thickened portion 186 may, alternatively, be located entirely within the second quadrant second half 178 and have an overall length equal to the dimension "b", FIG. 7, as previously described. Accordingly, in this alternative arrangement, the thickened portion 186 may be entirely located between the intersect point 190 (i.e., the 4:30 o'clock position) and the intersect point 88 (i.e., the 6 o'clock position) in the second half 178 of the score panel second quadrant 162 as illustrated in FIG. 7.

Operation

Opening of a can end 10 having the above configuration will now be described. As illustrated in FIGS. 1, 4 and 5, in an initial, undisturbed state, an upper surface 59 of the tab is generally parallel to the top surface 11 of the can main panel 20. A lower surface 57 of tab nose 51 is positioned in contact with the score panel 80. Upward pressure on the ring-end portion 52 of tab 50 causes tab 50 to pivot about axis AA, FIGS. 1 and 5, urging nose portion 51 downwardly and causing primary score 82 to begin rupturing at the 12 o'clock position 93 of the score profile. As the score rupture propagates clockwise past the 3 o'clock position, it begins to accelerate. This acceleration is reduced, however, as the rupture moves into and through the thickened score residual portion 186 in the second and/or third quadrants as previously described. After passing through the thickened portion 186, the rupture may continue through the relatively thinner residual in the fourth quadrant until it reaches the end 90 of the score line, at which point, the score panel 80 is fully separated from the remainder of the end and is free to pivot about the hinge portion 91.

Accordingly, provision of the thickened score residual portion 186, as previously described, prevents an undesirable acceleration of the score panel 80 into the can contents while allowing acceptable opening forces to be applied.

It is contemplated that the inventive concepts herein described may be variously otherwise embodied and it is intended that the appended claims be construed to include alternative embodiments of the invention except insofar as limited by the prior art.

What is claimed is:

1. A can end for a two-piece beverage can comprising:

a substantially flat portion extending substantially in a radial plane and having an upper surface and a lower surface;

a rivet mechanism formed in said substantially flat portion, said rivet mechanism having a central longitudinal axis extending in an axial direction which is substantially perpendicular to said radial plane;

a displaceable panel defined in said substantially flat portion by a score line, said score line comprising a score groove extending from said upper surface toward said lower surface and a frangible residual portion located between said score groove and said lower surface;

said displaceable panel being connected to the remainder of said flat portion by a non-scored hinge portion;

a first transverse axis lying generally in said radial plane and intersecting said rivet central longitudinal axis;

a pull tab attached to said substantially flat portion by said rivet mechanism, said pull tab being generally symmetrical with respect to said first transverse axis;

a second transverse axis, perpendicular to said first transverse axis and lying generally in said radial plane;

said second transverse axis intersecting a first portion and a second portion of said score line and being located such that the distance along said second transverse axis between said score line first portion and said score line second portion is maximized;

wherein said second transverse axis intersects said first transverse axis at a displaceable panel central point;

said first and second transverse axes defining four quadrants progressing in a clockwise direction when said can end is viewed from the upper surface thereof as follows:

a first quadrant containing a portion of said rivet mechanism and a portion of said score line;

a second quadrant located immediately adjacent said first quadrant and containing a portion of said score line;

a third quadrant located immediately adjacent said second quadrant and containing a portion of said score line; and a fourth quadrant located immediately adjacent both said third and first quadrants, said fourth quadrant containing at least a portion of said hinge portion, a portion of said rivet mechanism and a portion of said score line;

a third transverse axis lying in said radial plane and intersecting said displaceable panel central point, said third transverse axis lying at an angle of 45 degrees with respect to said first and second transverse axes;

said third transverse axis intersecting said score line in said second quadrant at a first intersection point;

a fourth transverse axis lying in said radial plane and intersecting said displaceable panel central point, said fourth transverse axis lying at an angle of 45 degrees with respect to said first and second transverse axes;

said fourth transverse axis intersecting said score line in said third quadrant at a second intersection point;

wherein said frangible residual portion includes a thickened portion having a thickness, measured in the direction of said rivet central longitudinal axis, which is relatively larger than at least one other portion of said frangible residual portion which is immediately adjacent said thickened portion; and wherein said thickened portion is entirely located between said first and second intersection points.

2. The can end of claim 1 wherein said first transverse axis intersects said score line between said second and third quadrants at a third intersection point; and said thickened portion is at least partially located between said first and third intersection points.

3. The can end of claim 2 wherein said thickened portion is entirely located between said first and third intersection points.

4. The can end of claim 1 wherein said first transverse axis intersects said score line between said second and third quadrants at a third intersection point; and said thickened portion is at least partially located between said second and third intersection points.

5. The can end of claim 1 wherein said thickened portion has a thickness, measured in the direction of said rivet central longitudinal axis, which is about 0.0004 inches larger than said at least one other portion of said frangible residual portion.

6. The can end of claim 1 and further including a ramped surface sloping between said thickened portion and said at least one other portion of said frangible residual portion.

7. The can end of claim 1 wherein said substantially flat portion has a thickness, measured in the direction of said rivet central longitudinal axis, of about 0.006 inches.

8. The can end of claim 1 wherein said thickened portion has a thickness, measured in the direction of said rivet central longitudinal axis, of about 0.0039 inches.

9. The can end of claim 1 wherein said at least one other portion of said frangible residual portion has a thickness, measured in the direction of said rivet central longitudinal axis, of about 0.0035 inches.

10. The can end of claim 1 wherein said pull tab has a nose portion positioned in overlying relationship with a portion of said displaceable panel.

* * * * *

UNITED STATES PATENT AND TRADEMARK OFFICE

CERTIFICATE OF CORRECTION

PATENT NO. : 5,964,366

DATED : October 12, 1999

INVENTOR(S) : Robert L. Hurst and Dennis K. Hidalgo

It is certified that error appears in the above-identified patent and that said Letters Patent are hereby corrected as shown below:

| | |
|---|---|
| Column 1, Line 5: | After "abandoned" insert "," |
| Column 2, Line 26: | After "Saunders;" do not begin a new paragraph |
| Column 4, Line 29: | After first occurrence of "a" delete "15" |
| Column 4, Line 40: | After "second" delete "25" |
| Column 5, Line 3: | Delete "o-lock" and insert therefor --o'clock-- |
| Column 6, Line 3: | Delete "$D_8$=0.2099" and insert therefor --$D_7$=0.2099-- |

Signed and Sealed this

Third Day of April, 2001

*Attest:*

Nicholas P. Godici

NICHOLAS P. GODICI

*Attesting Officer*

*Acting Director of the United States Patent and Trademark Office*